US010507467B2

(12) United States Patent
He

(10) Patent No.: US 10,507,467 B2
(45) Date of Patent: Dec. 17, 2019

(54) FREELY-ASSEMBLED ELISA PLATE

(71) Applicant: Shenyang Medical College, Liaoning (CN)

(72) Inventor: Shaoheng He, Liaoning (CN)

(73) Assignee: Shenyang Medical College, Liaoning (CN)

( * ) Notice: Subject to any disclaimer, the term of this patent is extended or adjusted under 35 U.S.C. 154(b) by 221 days.

(21) Appl. No.: 15/743,852

(22) PCT Filed: Aug. 11, 2016

(86) PCT No.: PCT/CN2016/094498
§ 371 (c)(1),
(2) Date: Jan. 11, 2018

(87) PCT Pub. No.: WO2018/006466
PCT Pub. Date: Jan. 11, 2018

(65) Prior Publication Data

US 2018/0200713 A1 Jul. 19, 2018

(30) Foreign Application Priority Data

Jul. 8, 2016 (CN) ..... 2016 1 0536668

(51) Int. Cl.
*B01L 3/00* (2006.01)

(52) U.S. Cl.
CPC ..... *B01L 3/50855* (2013.01); *B01L 3/502* (2013.01); *B01L 3/5088* (2013.01); (Continued)

(58) Field of Classification Search
CPC ... B01L 3/5058; B01L 9/52; B01L 2300/0829
See application file for complete search history.

(56) References Cited

U.S. PATENT DOCUMENTS 4,972,045 A * 11/1990 Primeau ..... H01H 15/10 174/66
2005/0265901 A1* 12/2005 Sinclair ..... B01L 9/06 422/552
2013/0330254 A1* 12/2013 Jensen ..... B01L 9/06 422/562

FOREIGN PATENT DOCUMENTS

CN 203732540 U 7/2014
CN 204462150 U 7/2015
(Continued)

OTHER PUBLICATIONS

International Searching Authority, Search Report issued in International Application No. PCT/CN2016/094498 dated Apr. 5, 2017 (5 pages).

*Primary Examiner* — Matthew D Krcha
(74) *Attorney, Agent, or Firm* — Wood Herron & Evans LLP

(57) ABSTRACT

A freely-assembled ELISA plate is provided, including a first ELISA plate frame, a second ELISA plate frame, and ELISA plate strips located between the first ELISA plate frame and the second ELISA plate frame, collectively forming a liquid flow groove. The first ELISA plate frame is connected to a first side of the ELISA plate strips. A second side of the ELISA strips is connected to the second ELISA plate frame. The number of the ELISA plate strips in the ELISA plate can be determined according to the sample size, so that the waste of well resources of the ELISA plate can be effectively reduced; and, a desired amount of samples, washing buffer or the like can be added into the liquid flow groove once for all, so that the sample loading amount can be reduced and the detection speed can be quickened.

13 Claims, 8 Drawing Sheets

(52) U.S. Cl.
CPC . *B01L 2200/028* (2013.01); *B01L 2300/0609* (2013.01); *B01L 2300/0825* (2013.01); *B01L 2300/0829* (2013.01); *B01L 2300/0851* (2013.01); *B01L 2300/0858* (2013.01); *B01L 2300/168* (2013.01)

(56) References Cited

FOREIGN PATENT DOCUMENTS

| | | | |
|---|---|---|---|
| CN | 105699644 | A | 6/2016 |
| CN | 105717289 | A | 6/2016 |
| CN | 205679618 | U | 11/2016 |
| CN | 205691595 | U | 11/2016 |
| CN | 205691597 | U | 11/2016 |
| CN | 205786656 | U | 12/2016 |
| CN | 205809078 | U | 12/2016 |

* cited by examiner

FREELY-ASSEMBLED ELISA PLATE

CROSS-REFERENCE TO RELATED APPLICATIONS

This application is a national phase of PCT/CN2016/094498, filed on Aug. 11, 2016, which claims priority to Chinese Patent Application No. 201610536668.7, which was filed at the Chinese Patent Office on Jul. 8, 2016. These prior applications are incorporated herein by reference, in their entireties.

TECHNICAL FIELD

The present invention relates to the field of immunity detection devices, and, in particular, to a freely-assembled ELISA plate.

BACKGROUND

The Enzyme Linked Immunosorbent Assay (ELISA) is the most common method for detecting target molecules in the life science field, and is widely applied in various organizations such as clinics and laboratories. An ELISA plate is a common consumable for the ELISA. At present, there are two categories of commonly used ELISA plates, i.e., conventional non-detachable ELISA plates and detachable ELISA plates. For the non-detachable ELISA plates, plate strips of the whole plate are connected together; while for the detachable ELISA plates, plate strips of the whole plate are separated from each other, and there are generally 12 or 8 wells on each separated plate strip.

In the prior art, for a non-detachable ELISA plate, since all plate strips and wells are fixed on a plate frame, the non-detachable ELISA plate cannot be freely assembled according to the required amount; and, a detachable ELISA plate also consists of fixed plate strips, the number of ELISA wells on each plate strip is fixed, and the plate strips are not detachable. The waste of well resources of the ELISA plates will be caused when the two ELISA plates are used in organizations, such as hospitals, communities and families, which have a small amount of samples. During the detection of multiple components in a single sample, the ELISA plates have the following particularly prominent disadvantages: (1) a certain volume of sample needs to be added into each ELISA plate well, so the waste of some rare samples is caused; (2) during the manual or mechanical addition of a sample or a reagent into the ELISA plate, the sample or reagent needs to be added well by well or strip by strip, so the speed is slow and the detection time is prolonged; (3) since the amount of liquid added into each ELISA plate well is relatively small, usually several microliters to hundreds of microliters, the sample loading amount is very easy to be affected by human factors, instruments and consumables, thereby resulting in inaccurate results of detection; and (4) additionally, since the conventional ELISA plates require sample loading appliances such as a pipette, so it is not convenient for small organizations such as communities or families. Therefore, how to freely assemble the ELISA plate and reduce the sample loading amount to achieve the technical effects of quickly and accurately detecting multiple components in a single sample becomes a technical issue to be urgently solved in the art at present.

SUMMARY

In view of this, an objective of the present invention is to provide a freely-assembled ELISA plate which solves the problems of the waste of samples and ELISA plates and the complicated operation of loading samples in the prior art.

To achieve the inventive objective, the present invention employs the following technical solutions.

The present invention, in one embodiment, provides a freely-assembled ELISA plate, including: a first ELISA plate frame, a second ELISA plate frame, and ELISA plate strips located between the first ELISA plate frame and the second ELISA plate frame; the first ELISA plate frame includes a first outer wall, a first bottom plate and first connecting members (1), the first bottom plate being connected to an inner edge on a bottom end of the first outer wall, and the first connecting members (1) being located at two inner ends of the first outer wall and on an inner side of the first bottom plate; each of the ELISA plate strips includes two side walls connected to the first ELISA plate frame and the second ELISA plate frame, a substrate, second connecting members (2) and third connecting members (3), the second connecting members being detachably connected to the first ELISA plate frame, and the third connecting members being detachably connected to the second ELISA plate frame; the second ELISA plate frame includes a second outer wall, a second bottom plate and fourth connecting members (4), the second bottom plate being connected to an inner edge on a bottom end of the second outer wall, and the fourth connecting members (4) being detachably connected to the ELISA plate strips; and the first ELISA plate frame, the second ELISA plate frame, and the side walls and substrates of the ELISA plate strips form a liquid flow groove of the ELISA plate.

In one aspect, the number of the ELISA plate strips is 1 to 20.

In some embodiments, when the number of the ELISA plate strips is 2 to 20, the ELISA plate strips are connected pairwise through the second connecting members (2) and the third connecting members (3).

In further embodiments, the number of the first connecting members is 2 to 6.

In another aspect, the number of each of the second connecting members (2), the third connecting members (3) and the fourth connecting members (4) is equal to the number of the first connecting members (1).

In some embodiments, both the first connecting members (1) and the third connecting members (3) are clips with a buckle structure.

For example, both the second connecting members (2) and the fourth connecting members (4) may be troughs with a buckle structure.

In another aspect, ELISA plate wells are formed on the substrate of each of the ELISA plate strips, the width of the substrate of each of the ELISA plate strips is designed to accommodate one ELISA plate well, and the number of the ELISA plate wells on each of the ELISA plate strips is 1 to 8.

In yet another aspect, the ELISA plate wells are equidistantly distributed on the substrates of the ELISA plate strips.

In some embodiments, each of the ELISA plate wells includes a hemispherical bottom, a funnel-shaped formation connected to an upper edge of the hemispherical bottom, and a projecting wall connected to an upper edge of the funnel-shaped formation. The hemispherical bottom includes a primary hemisphere and a secondary hemisphere which is located inside the primary hemisphere and protruded inward. The funnel-shaped formation consists of two portions, i.e., a hollow spherical segment located in a lower portion and a truncated hollow cone connected to an upper edge of the hollow spherical segment. A lower edge of the hollow spherical segment is connected to the upper edge of the hemispherical bottom; and an upper edge of the truncated hollow cone is connected to a lower edge of the projecting wall.

The present invention achieves at least the following advantages and technical effects: in the freely-assembled ELISA plate provided by the present invention, the number of the ELISA plate strips can be determined according to the sample size to realize the detection of a large, intermediate or small number of samples, so that the waste of well resources of the ELISA plate can be effectively reduced, and this facilitates the popularization of the ELISA plates in various organizations such as hospitals, communities and families. Furthermore, in the ELISA plate of the present invention, because detachable connecting structures are provided on the first ELISA plate frame, the second ELISA plate frame, and the left and right side walls of the ELISA plate strips, the ELISA plate frames and the ELISA plate strips may be connected to form an ELISA plate with good sealing. Moreover, since the first ELISA plate frame, the second ELISA plate frame, the side walls of the ELISA plate strips, and the substrate of the ELISA plate strips together form a liquid flow groove structure of the ELISA plate, and during the detection of multiple factors in a single sample, a desired amount of the sample, washing buffer or other reagents may be added into the liquid flow groove once for all according to the operation process, so that the sample loading amount may be reduced and the detection speed may be quickened.

BRIEF DESCRIPTION OF THE DRAWINGS

Various additional features and advantages of the invention will become more apparent to those of ordinary skill in the art upon review of the following detailed description of one or more illustrative embodiments taken in conjunction with the accompanying drawings. The accompanying drawings, which are incorporated in and constitute a part of this specification, illustrate one or more embodiments of the invention and, together with the general description given above and the detailed description given below, explain the one or more embodiments of the invention.

DETAILED DESCRIPTION

Figure 1A:
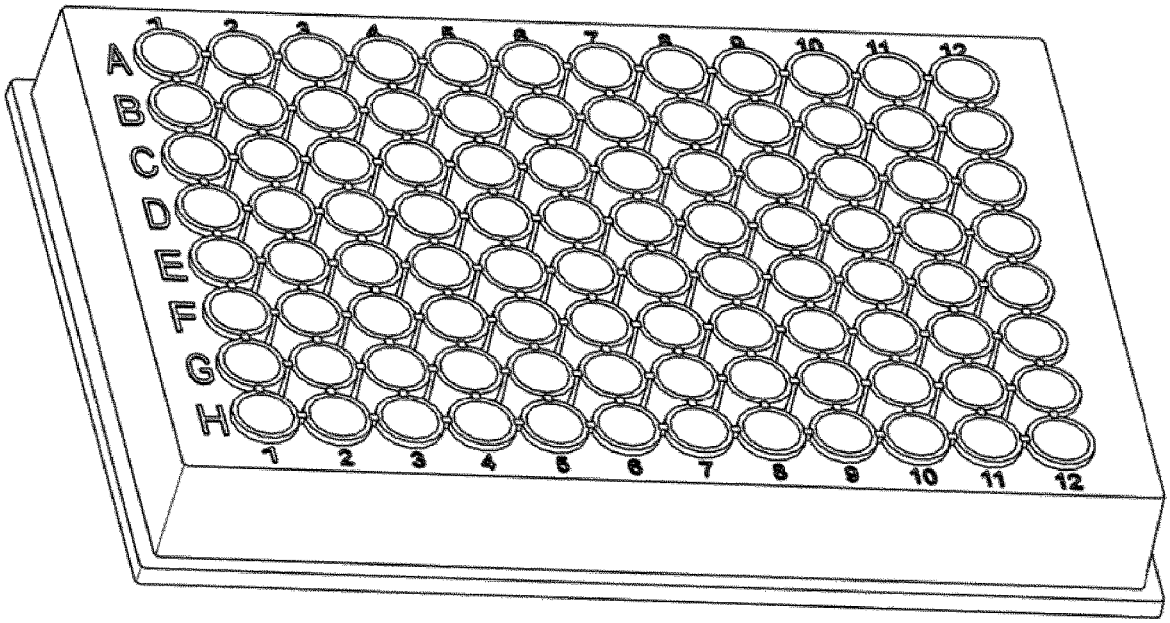
Fig. 1A Prior Art
FIG. 1A is a perspective view of a non-detachable ELISA plate in the prior art.
Figure 1B:
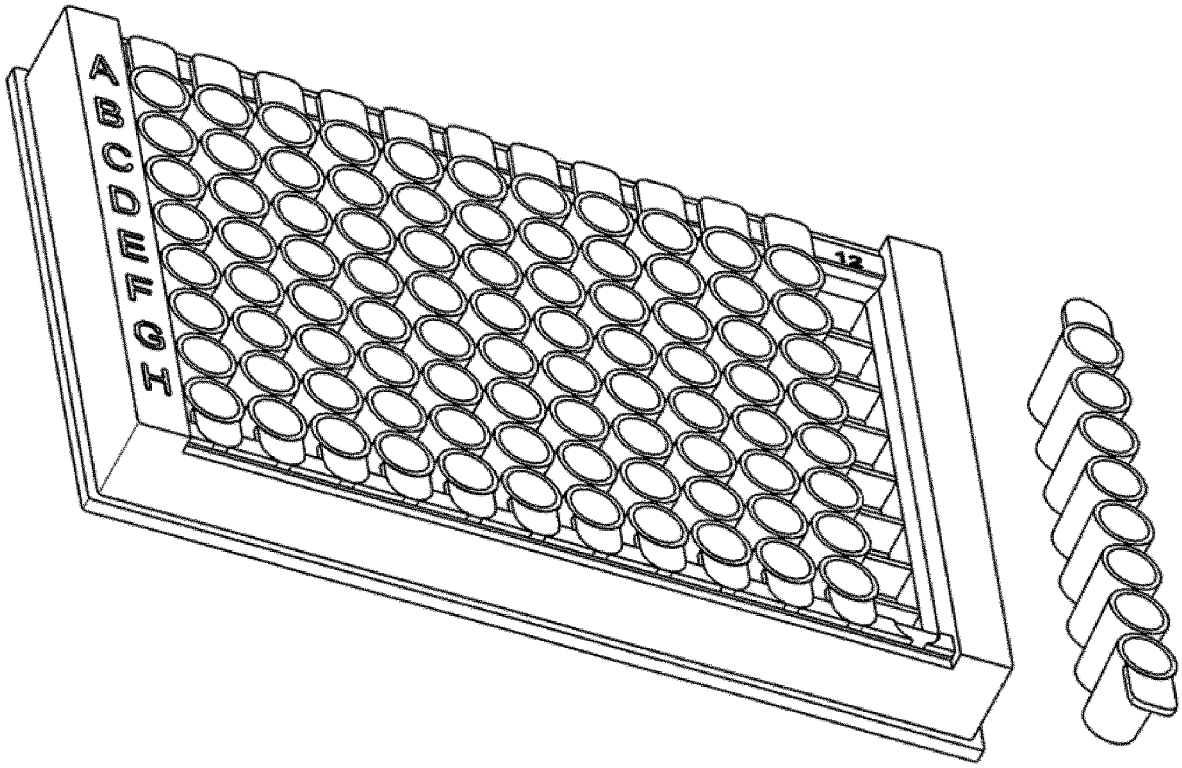
Fig. 1B Prior Art
FIG. 1B is a perspective view of a detachable ELISA plate in the prior art.
Figure 2A:
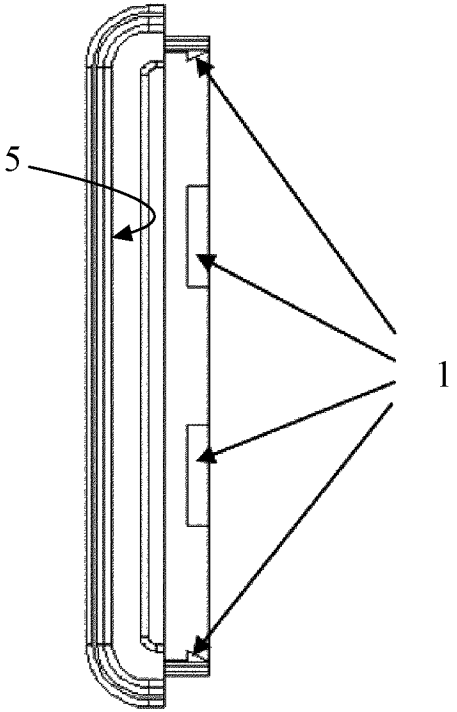
FIG. 2A is a top view of a first ELISA plate frame of a freely-assembled ELISA plate according to several embodiments of the present invention.
Figure 2D:
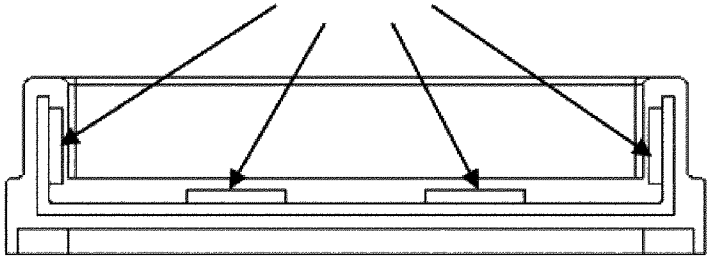
FIG. 2D is a right side view of the first ELISA plate frame of the freely-assembled ELISA plate of FIG. 2A.
Figure 2B:
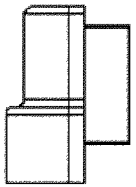
FIG. 2B is a front view of the first ELISA plate frame of the freely-assembled ELISA plate of FIG. 2A.
Figure 2C:
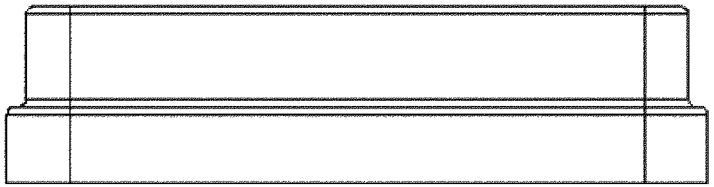
FIG. 2C is a left side view of the first ELISA plate frame of the freely-assembled ELISA plate of FIG. 2A.
Figure 3A:
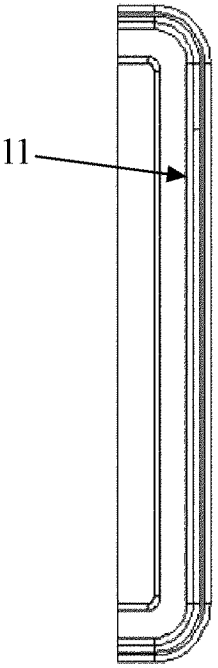
FIG. 3A is a top view of a second ELISA plate frame of the freely-assembled ELISA plate according to several embodiments of the present invention.
Figure 3B:
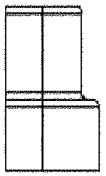
FIG. 3B is a front view of the second ELISA plate frame of the freely-assembled ELISA plate of FIG. 3A.
Figure 3D:
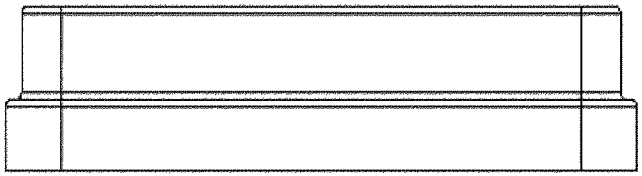
FIG. 3D is a right side view of the second ELISA plate frame of the freely-assembled ELISA plate of FIG. 3A.
Figure 3C:
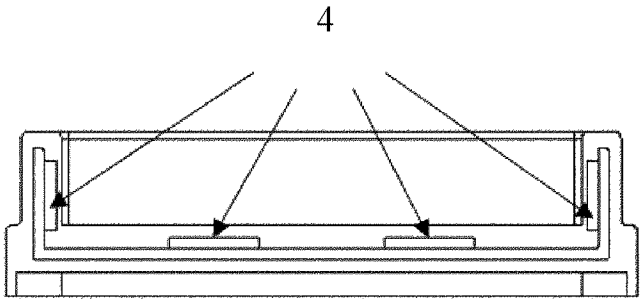
FIG. 3C is a left side view of the second ELISA plate frame of the freely-assembled ELISA plate of FIG. 3A.
Figure 4A:
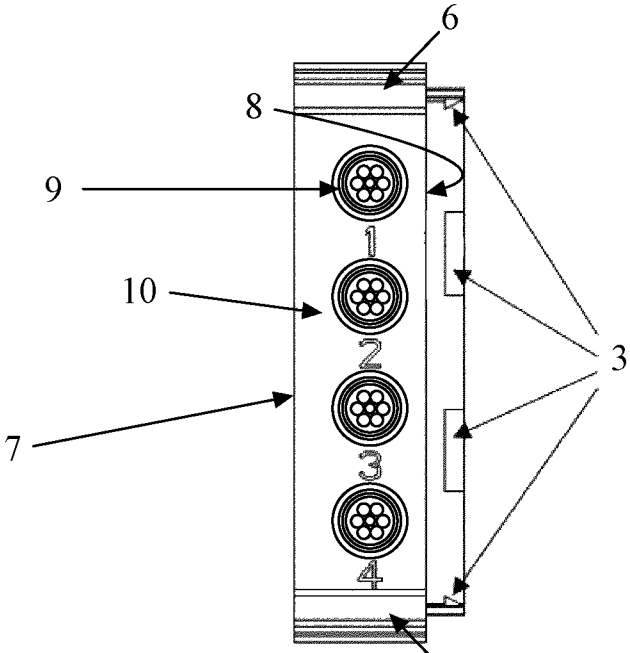
FIG. 4A is a top view of a plate strip of the freely-assembled ELISA plate according to several embodiments of the present invention.
Figure 4D:
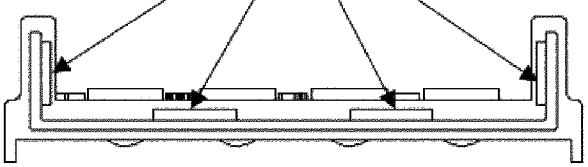
FIG. 4D is a right side view of the plate strip of the freely-assembled ELISA plate of FIG. 4A.
Figure 4B:
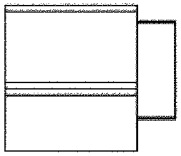
FIG. 4B is a front view of the plate strip of the freely-assembled ELISA plate of FIG. 4A.
Figure 4C:
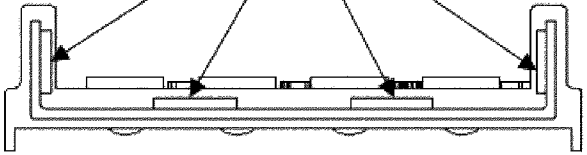
FIG. 4C is a left side view of the plate strip of the freely-assembled ELISA plate of FIG. 4A.

The embodiments of the present invention provide several technical effects and advantages over convention designs of ELISA plates. Two such examples of conventional ELISA plate designs are shown in FIGS. 1A and 1B, and the deficiencies thereof are described below (following further description of the embodiments of the present invention for comparison), as well as in the Background section.

With reference to FIGS. 2A through 8 (showing first and second embodiments referred to herein as Embodiment 1 and Embodiment 2), the present invention provides a freely-assembled ELISA plate, including the following components: a first ELISA plate frame, a second ELISA plate frame, and ELISA plate strips located between the first ELISA plate frame and the second ELISA plate frame. The first ELISA plate frame includes a first outer wall, a first bottom plate and first connecting members (1). The first bottom plate is connected to an inner edge on a bottom end of the first outer wall. The first connecting members (1) are located at two inner ends of the first outer wall and on an inner side of the first bottom plate. Each of the ELISA plate strips includes two side walls connected to the first ELISA plate frame and the second ELISA plate frame, a substrate, second connecting members (2) and third connecting members (3). The second connecting members are detachably connected to the first ELISA plate frame, and the third connecting members are detachably connected to the second ELISA plate frame. The second ELISA plate frame includes a second outer wall, a second bottom plate and fourth connecting members (4). The second bottom plate is connected to an inner edge on a bottom end of the second outer wall. The fourth connecting members (4) are detachably connected to the ELISA plate strips.

The first ELISA plate frame, the second ELISA plate frame, and the side walls and substrates of the ELISA plate strips form a liquid flow groove of the ELISA plate.

Figure 5B:
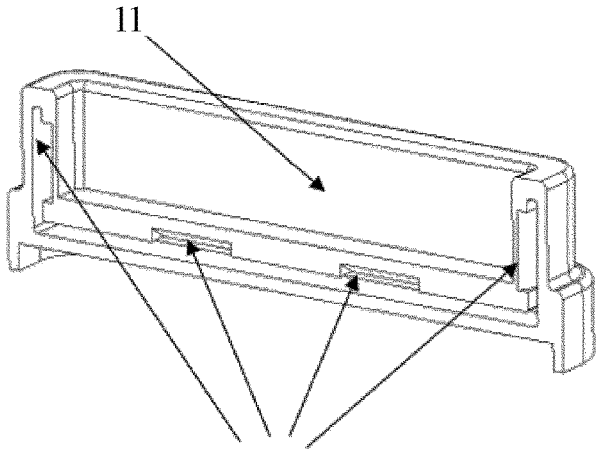
FIG. 5B is a perspective view of the second ELISA plate frame of the freely-assembled ELISA plate of FIGS. 3A through 3D and according to embodiments of the present invention.
Figure 5C:
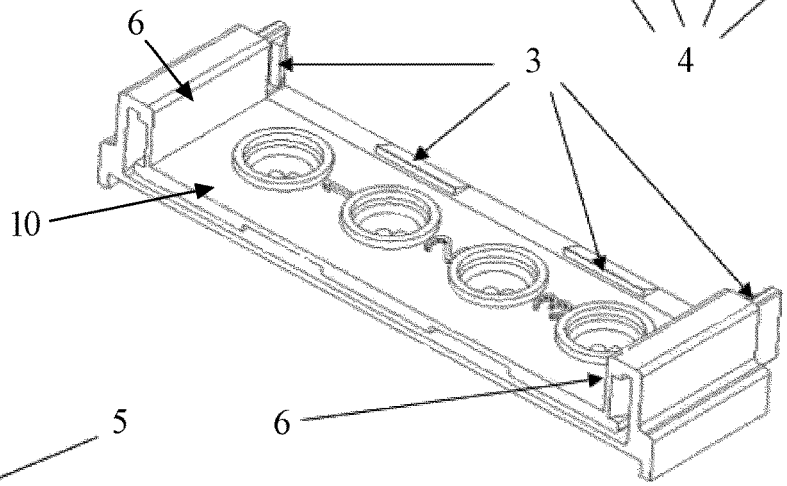
FIG. 5C is a perspective view of the ELISA plate strip of the freely-assembled ELISA plate of FIGS. 4A through 4D and according to embodiments of the present invention.
Figure 5A:
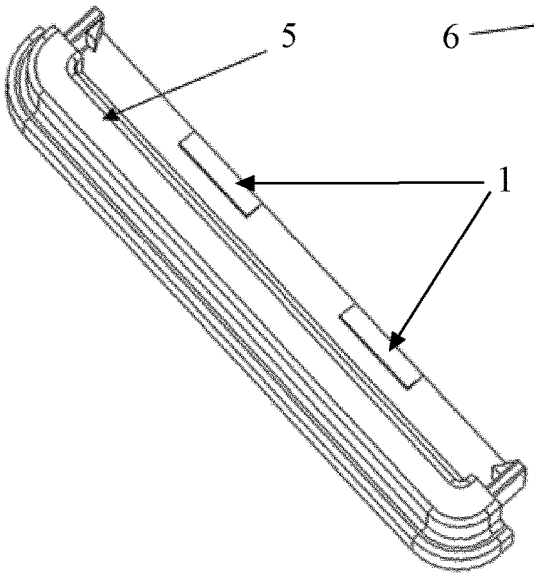
FIG. 5A is a perspective view of the first ELISA plate frame of the freely-assembled ELISA plate of FIGS. 2A through 2D and according to embodiments of the present invention.

In embodiments of the present invention, as shown in FIGS. 2A through 2D and in FIG. 5A, the first ELISA plate frame includes a first outer wall, a first bottom plate and first connecting members (1). In an embodiment of the present invention, there may be specifically 2 to 6 first connecting members; while in another embodiment, there may be 3 to 5 first connecting members. In one example, the number of the first connecting members is 4.

In embodiments of the present invention, the first connecting members (1) are located at two inner ends of the first outer wall and on an inner side of the first bottom plate, respectively. When there are 4 first connecting members (1), one first connecting member (1) is arranged at each of the two inner ends of the first outer wall, respectively, and two first connecting members (1) are evenly distributed on the first bottom plate. In the present invention, the first connecting members (1) are used for detachably connecting the first ELISA plate frame to the ELISA plate strips. In a specific embodiment, the first connecting member may be a clip of a buckle structure.

In embodiments of the present invention, as shown in FIGS. 3A through 3D and in FIG. 5B, the second ELISA plate frame includes a second outer wall, a second bottom plate and fourth connecting members (4). In an embodiment of the present invention, there may be specifically 2 to 6 fourth connecting members (4); while in another embodiment, there may be 3 to 5 fourth connecting members (4). In one example, there are 4 fourth connecting members (4). In the embodiments of the present invention, the number of the fourth connecting members (4) is equal to the number of the first connecting members (1).

In embodiments of the present invention, the fourth connecting members (4) are located at two inner ends of the second outer wall and on an inner side of the second bottom plate, respectively. When there are 4 fourth connecting members (4), one of the fourth connecting members (4) is arranged at each of the two inner ends of the second outer wall, respectively, and two of the fourth connecting members (4) are evenly distributed on the second bottom plate. The positions of the fourth connecting members (4) are symmetric with the positions of the first connecting members of the first ELISA plate frame. In the present invention, the fourth connecting members (4) are used for detachably connecting the second ELISA plate frame to the ELISA plate strips. In a specific embodiment, the fourth connecting member (4) may be a trough of a buckle structure.

Figure 6B:
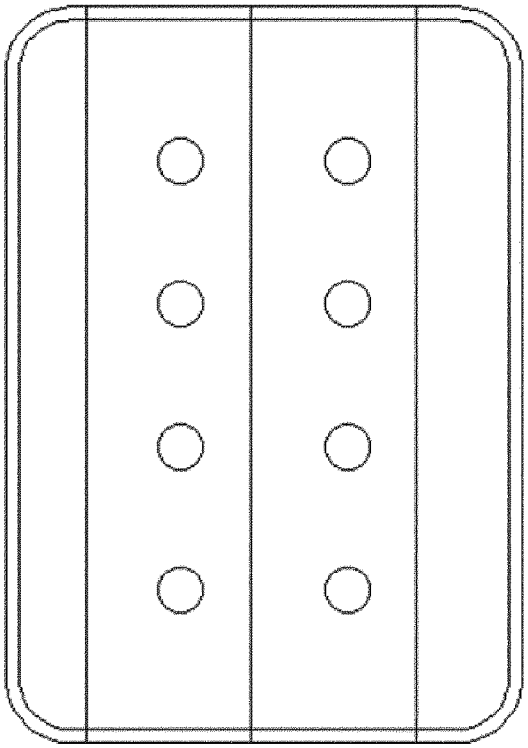
FIG. 6B is a bottom view of the freely-assembled ELISA plate of FIG. 6A.
Figure 6D:
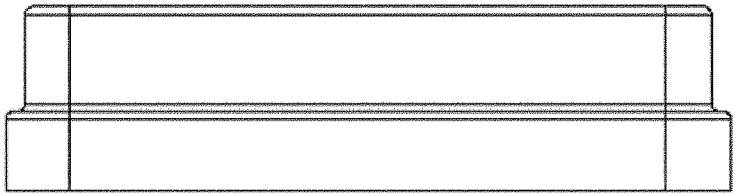
FIG. 6D is a side view of the freely-assembled ELISA plate of FIG. 6A.
Figure 6A:
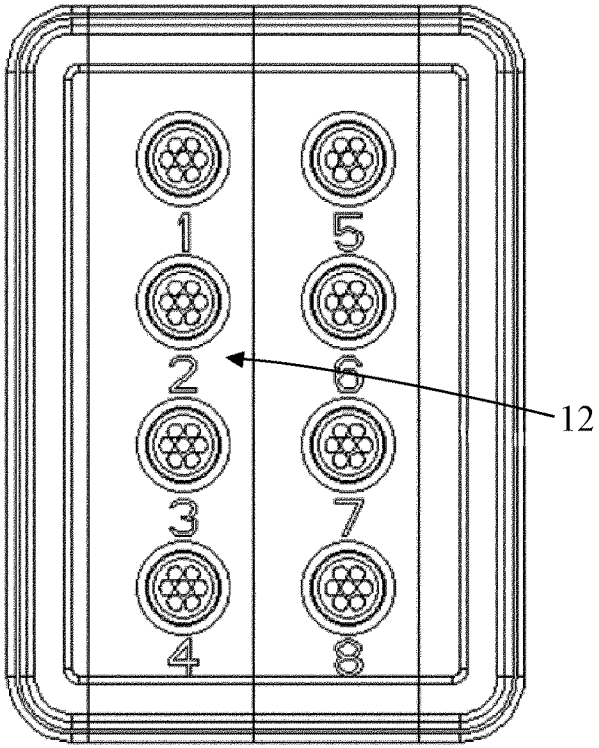
FIG. 6A is a top view of the freely-assembled ELISA plate in a fully assembled state and having eight wells arranged in a 4×2 rectangular array according a first embodiment of the present invention.
Figure 6C:
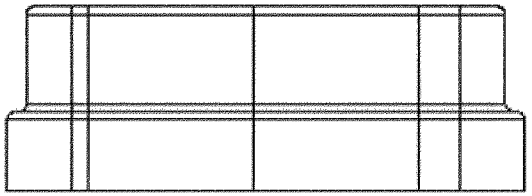
FIG. 6C is a front view of the freely-assembled ELISA plate of FIG. 6A.
Figure 6E:
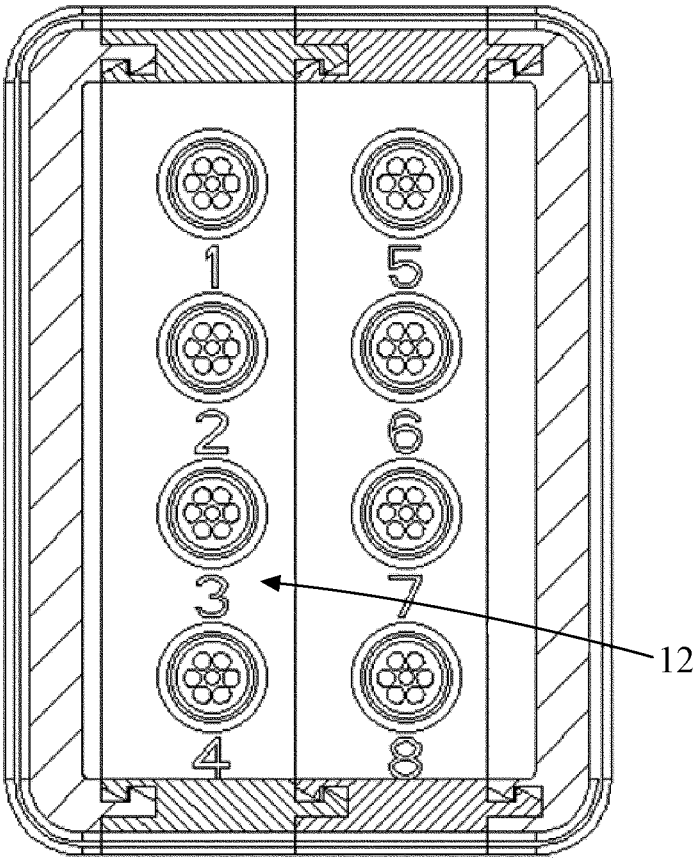
FIG. 6E is a partially sectioned top view of the freely-assembled ELISA plate of FIG. 6A.
Figure 6F:
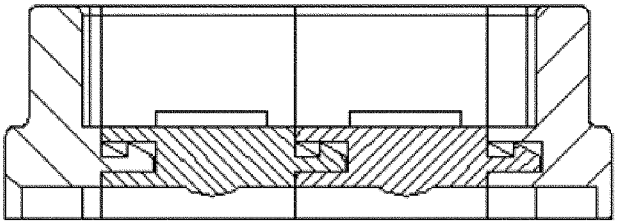
FIG. 6F is a partially sectioned front view of the freely-assembled ELISA plate of FIG. 6A.
Figure 6G:
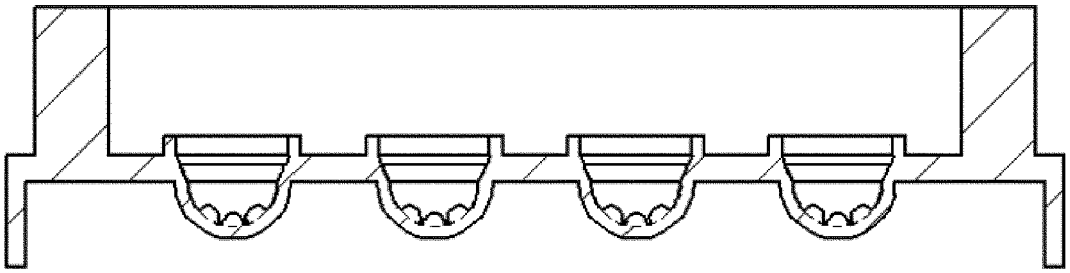
FIG. 6G is a partially sectioned side view of the freely-assembled ELISA plate of FIG. 6A.
Figure 7:
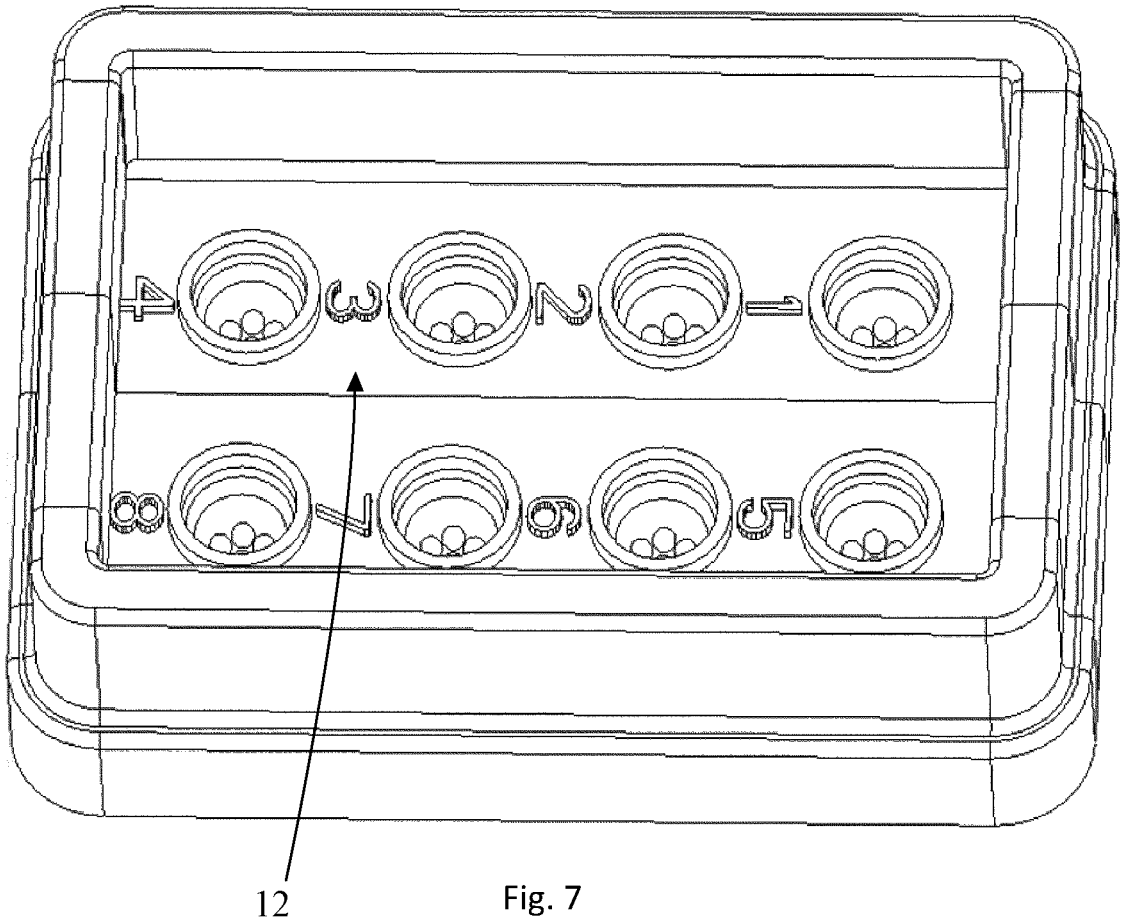
FIG. 7 is a perspective view of the assembled ELISA plate arranged in a 4×2 rectangular array according to the first embodiment of the present invention and as shown in FIGS. 6A through 6G.
Figure 8:
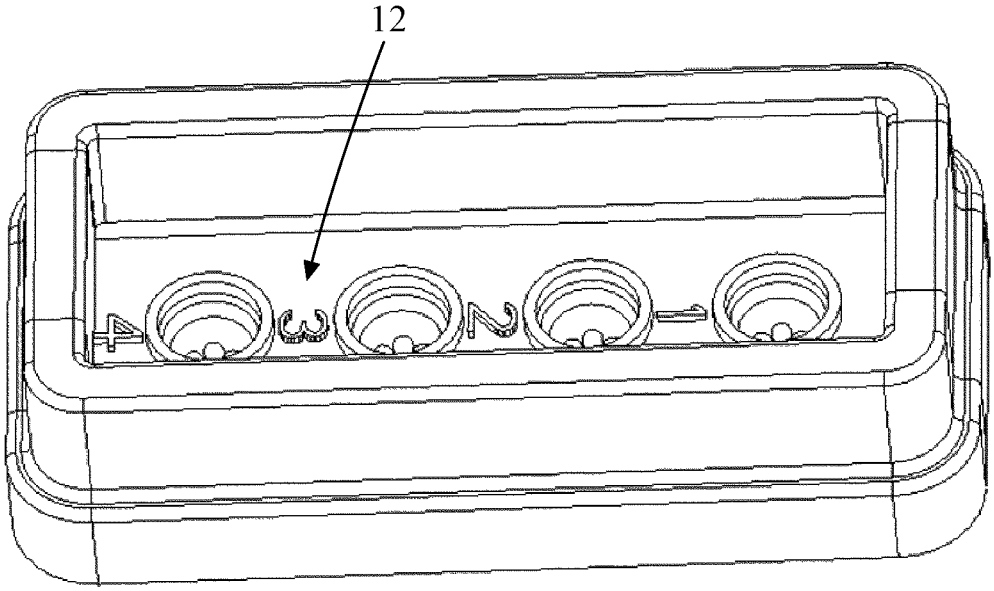
FIG. 8 is a perspective view of the freely-assembled ELISA plate arranged in a 4×1 rectangular array according to a second embodiment of the present invention.

The freely-assembled ELISA plate of the present invention includes ELISA plate strips. The number of the ELISA plate strips may be selected by those skilled in the art as desired. In an embodiment of the present invention, there may be specifically 1 to 20 ELISA plate strips. In specific embodiments, FIGS. 6A through 7 show an ELISA plate with two ELISA plate strips according to Embodiment 1, and FIG. 8 shows an ELISA plate with one ELISA plate strip according to Embodiment 2.

In embodiments of the present invention, as shown in FIGS. 4A through 4D and in FIG. 5C, each of the ELISA plate strips includes two side walls connected to the first ELISA plate frame and the second ELISA plate frame, a substrate, second connecting members (2) and third connecting members (3). The second connecting members (2) are used for realizing the detachable connection to the first connecting members (1) or connecting members on other ELISA plate strips, so as to realize the detachable connection between the first ELISA plate frame and the ELISA plate strips or the detachable connection between the ELISA plate strips.

In an embodiment of the present invention, there may be specifically 2 to 6 second connecting members (2); while in another embodiment, there may be 3 to 5 second connecting members (2). In one example, there are 4 second connecting members (2). In the embodiments of the present invention, the number of the second connecting members (2) is equal to the number of the first connecting members (1).

In embodiments of the present invention, the second connecting members (2) are located on a first side of the two side walls and the substrate. When there are 4 second connecting members (2), one of the second connecting members (2) is arranged on a first side of each of the two side walls of this ELISA plate strip, respectively, and two of the second connecting members (2) are evenly distributed on a first side of the substrate of this ELISA plate strip. The positions of the second connecting members (2) are symmetric with the positions of the first connecting members (1) of the first ELISA plate frame.

In embodiments of the present invention, the second connecting members (2) are used for detachably connecting an ELISA plate strip to the first ELISA plate frame or to a second side of other ELISA plate strips. In a specific embodiment, the second connecting member (2) may be a trough of a buckle structure.

In embodiments of the present invention, the third connecting members (3) are located on a second side of the two side walls and the substrate of this ELISA plate strip. When there are four third connecting members (3), one of the third connecting members (3) is arranged on a second side of each of the two side walls of this ELISA plate strip, respectively, and two of the third connecting members (3) are evenly distributed on a second side of the substrate of this ELISA plate strip. The positions of the third connecting members (3) are symmetric with the positions of the fourth connecting members (4) of the second ELISA plate frame.

In embodiments of the present invention, the third connecting members (3) are used for detachably connecting an ELISA plate strip to the second ELISA plate frame or to a first side of other ELISA plate strips. In a specific embodiment, the third connecting member (3) may be a clip of a buckle structure.

In embodiments of the present invention, when there is one ELISA plate strip, the first ELISA plate frame is detachably connected to the second connecting members (2) of the ELISA plate strip through the first connecting members (1), and the second side of the ELISA plate strip is detachably connected to the fourth connecting members (4) of the second ELISA plate frame through the third connecting members (3). When there are 2 to 20 ELISA plate strips, the first ELISA plate frame is connected to the first side of the first ELISA plate strip through the first connecting members (1) and the second connecting members (2) of the ELISA plate strip; the second side of the first ELISA plate strip is connected to the first side of the second ELISA plate strip through the third connecting members (3) and the second connecting members (2) of the second ELISA plate frame; and similarly, the second side of the last ELISA plate strip is connected to the second ELISA plate frame through the third connecting members (3) and the connecting members (4) on the second ELISA plate frame.

In one aspect of the present invention, ELISA plate wells are formed on the substrate of each of the ELISA plate strips, the width of the substrate of each of the ELISA plate strips is designed to accommodate one ELISA plate well, and there are 1 to 8 ELISA plate wells on each of the ELISA plate strips. The number of the ELISA plate wells on each of the ELISA plate strips is preferably 1 to 8, more preferably 2 to 6 and most preferably 4. The ELISA plate wells are equidistantly distributed on the substrates of the ELISA plate strips.

In another aspect of the present invention, the ELISA plate wells serve as containers for biological reactions. In the illustrated embodiments, each of the ELISA plate wells includes a hemispherical bottom, a funnel-shaped formation connected to an upper edge of the hemispherical bottom, and a projecting wall connected to an upper edge of the funnel-shaped formation. The hemispherical bottom includes a primary hemisphere and a secondary hemisphere which is located inside the primary hemisphere and protruded inward. The funnel-shaped formation consists of two portions, i.e., a hollow spherical segment located in a lower portion and a truncated hollow cone connected to an upper edge of the hollow spherical segment. A lower edge of the hollow spherical segment is connected to the upper edge of the hemispherical bottom; and, an upper edge of the truncated hollow cone is connected to a lower edge of the projecting wall.

By providing the bottom of each of the ELISA plate wells with a hemispherical structure, the surface area of the ELISA plate wells is increased, so that the opportunity for a target substance to come into contact with target molecules on the surface of a solid phase is increased, and the content of the target substance may be detected by using a small amount of samples. In the present invention, there is a void between the adjacent secondary hemispheres. The void serves as a liquid flow channel of the ELISA plate wells, so that the liquid is allowed to freely flow in the ELISA plate wells, and the opportunity for the target substance to come into contact with the target molecules on the surface of the solid phase is thus increased. In the present invention, the projecting wall functions to prevent the cross contamination between the ELISA plate wells during experiments.

In the present invention, the first ELISA plate frame, the second ELISA plate frame, and the side walls and substrates of the ELISA plate strips form a liquid flow groove of the ELISA plate. During the detection of multiple factors in a single sample, instead of adding a sample or washing buffer into the ELISA plate wells one by one when in use of the ELISA plate in the prior art, a desired amount of the sample, washing buffer or other reagents may be added into the liquid flow groove once for all according to the operation process, so that the sample loading amount may be reduced and the detection speed may be quickened.

The ELISA plate wells 9 serve as reaction devices for the ELISA plate and interiors of which may be coated as desired. The first outer wall 5, the two side walls 6, the substrates 10 and the second outer wall 11 together form a liquid flow groove 12.

During the detection of multiple components in a single sample, the conventional ELISA plate shown in FIGS. 1A and 1B has the following disadvantages: a certain volume of sample needs to be added into each ELISA plate well, so the waste of some rare samples is caused; during the manual or mechanical addition of a sample or a reagent into the ELISA plate, the sample or reagent needs to be added well by well or strip by strip, so the speed is slow and the detection time is prolonged; because the amount of liquid added into each ELISA plate well is relatively small, usually several microliters to hundreds of microliters, the sample loading amount is very easy to be affected by human factors, instruments and consumables, resulting in inaccurate result of detection; and additionally, because the conventional ELISA plates require sample loading appliances such as a pipette, so it is not convenient for small organizations such as communities and families.

In the embodiments of the present invention, the ELISA plate strips may be customized and freely assembled as desired. In the present invention, the fluid flow groove is designed in such a way that a desired amount of a sample, washing buffer or other reagents required for reaction may be added into the liquid flow groove once for all according to the operation process, and the sample may be properly diluted as desired. Because a particular component in the sample is combined with only the ELISA plate wells coated with a corresponding component antigen on the bottom, the sample loading amount required is small for the ELISA plate of the present invention. Because the liquid added into the liquid flow groove is added massively once for all, the influence of the human factors, instruments, consumables and the like on the results of detection may be effectively reduced. Accordingly, the accuracy of the results of detection can be improved, and the detection time extension caused by adding liquid well by well or strip by strip can be decreased. The free-assembled ELISA plate of the present invention is simple in structure and convenient for manufacturing.

Although the principle and implementations of the present invention have been described above by specific examples in the present invention, the foregoing description of the embodiments is merely for helping understanding the method and core idea of the present invention. Meanwhile, various alterations to the specific implementations and applications may come to a person of ordinary skill in the art according to the concepts of the present invention. In conclusion, the contents of the description shall not be regarded as limitations to the present invention.

REFERENCE LIST

1: Connecting member clips of the first ELISA plate frame of the ELISA plate
2: Second connecting member troughs of the ELISA plate strips
3: Third connecting member clips of the ELISA plate strips
4: Fourth connecting member troughs of the second ELISA plate frame
5: First outer wall of the first ELISA plate frame
6: Two side walls of the first ELISA plate strip
7: First side of the substrate of the ELISA plate strip
8: Second side of the substrate of the ELISA plate strip
9: ELISA plate wells
10: Substrates of the ELISA plate strips
11: Second outer wall of the second ELISA plate frame
12: Liquid flow groove

What is claimed is:

1. A freely-assembled ELISA plate, comprising:
a first ELISA plate frame,
a second ELISA plate frame, and ELISA plate strips located between the first ELISA plate frame and the second ELISA plate frame;

wherein, the first ELISA plate frame comprises a first outer wall, a first bottom plate and first connecting members, the first bottom plate being connected to an inner edge on a bottom end of the first outer wall, and the first connecting members being located at two inner ends of the first outer wall and on an inner side of the first bottom plate;

each of the ELISA plate strips comprises two side walls connected to the first ELISA plate frame and the second ELISA plate frame, a substrate, second connecting members and third connecting members, the second connecting members being detachably connected to the first ELISA plate frame, and the third connecting members being detachably connected to the second ELISA plate frame;

the second ELISA plate frame comprises a second outer wall, a second bottom plate and fourth connecting members, the second bottom plate being connected to an inner edge on a bottom end of the second outer wall, and the fourth connecting members being detachably connected to the ELISA plate strips;

the first ELISA plate frame, the second ELISA plate frame, and the side walls and the substrates of the ELISA plate strips form a liquid flow groove of the ELISA plate; and wherein ELISA plate wells are formed on the substrate of each of the ELISA plate strips, a width of the substrate of each of the ELISA plate strips is designed to accommodate one ELISA plate well.

2. The ELISA plate according to claim 1, wherein a number of the ELISA plate strips is in the range of 1 to 20.

3. The ELISA plate according to claim 2, wherein, when a number of the ELISA plate strips is in the range of 2 to 20, the ELISA plate strips are connected pairwise through the second connecting members and the third connecting members.

4. The ELISA plate according to claim 1, wherein a number of the first connecting members is in the range of 2 to 6.

5. The ELISA plate according to claim 1, wherein a number of each of the second connecting members, the third connecting members and the fourth connecting members is equal to the number of the first connecting members.

6. The ELISA plate according to claim 5, wherein both the first connecting members and the third connecting members are clips with a buckle structure.

7. The ELISA plate according to claim 5, wherein both the second connecting members and the fourth connecting members are troughs with a buckle structure.

8. The ELISA plate according to claim 1, wherein a number of the ELISA plate wells on each of the ELISA plate strips is in the range of 1 to 8.

9. The ELISA plate according to claim 8, wherein the ELISA plate wells are equidistantly distributed on the substrates of the ELISA plate strips.

10. The ELISA plate according to claim 9, wherein each of the ELISA plate wells comprises a hemispherical bottom, a funnel-shaped formation connected to an upper edge of the hemispherical bottom, and a projecting wall connected to an upper edge of the funnel-shaped formation; wherein, the hemispherical bottom comprises a primary hemisphere and a secondary hemisphere which is located inside the primary hemisphere and protruded inward; the funnel-shaped formation consists of two portions, i.e., a hollow spherical segment located in a lower portion and a truncated hollow cone connected to an upper edge of the hollow spherical segment; a lower edge of the hollow spherical segment is connected to the upper edge of the hemispherical bottom; and, an upper edge of the truncated hollow cone is connected to a lower edge of the projecting wall.

11. The ELISA plate according to claim 8, wherein each of the ELISA plate wells comprises a hemispherical bottom, a funnel-shaped formation connected to an upper edge of the hemispherical bottom, and a projecting wall connected to an upper edge of the funnel-shaped formation; wherein, the hemispherical bottom comprises a primary hemisphere and a secondary hemisphere which is located inside the primary hemisphere and protruded inward; the funnel-shaped formation consists of two portions, i.e., a hollow spherical segment located in a lower portion and a truncated hollow cone connected to an upper edge of the hollow spherical segment; a lower edge of the hollow spherical segment is connected to the upper edge of the hemispherical bottom; and, an upper edge of the truncated hollow cone is connected to a lower edge of the projecting wall.

12. The ELISA plate according to claim 1, wherein both the first connecting members and the third connecting members are clips with a buckle structure.

13. The ELISA plate according to claim 1, wherein both the second connecting members and the fourth connecting members are troughs with a buckle structure.

* * * * *